US007731185B2

(12) United States Patent
Dobrindt

(10) Patent No.: US 7,731,185 B2
(45) Date of Patent: Jun. 8, 2010

(54) DEVICE FOR PLACING SHEETS FOR A PRINTER

(75) Inventor: Dirk Dobrindt, Klausdorf/Schwentine (DE)

(73) Assignee: Eastman Kodak Company, Rochester, NY (US)

( * ) Notice: Subject to any disclaimer, the term of this patent is extended or adjusted under 35 U.S.C. 154(b) by 414 days.

(21) Appl. No.: 10/569,056

(22) PCT Filed: Aug. 20, 2004

(86) PCT No.: PCT/US2004/027103

§ 371 (c)(1),
(2), (4) Date: Oct. 6, 2006

(87) PCT Pub. No.: WO2005/019077

PCT Pub. Date: Mar. 3, 2005

(65) Prior Publication Data

US 2007/0284808 A1 Dec. 13, 2007

(30) Foreign Application Priority Data

Aug. 22, 2003 (DE) ..... 103 38 596

(51) Int. Cl.
*B65H 29/00* (2006.01)

(52) U.S. Cl. ..... 271/187; 271/315

(58) Field of Classification Search ..... 271/315, 271/187

See application file for complete search history.

(56) References Cited

U.S. PATENT DOCUMENTS

| | | | | |
|---|---|---|---|---|
| 3,046,009 | A * | 7/1962 | Hartel | 271/176 |
| 3,968,960 | A | 7/1976 | Fedor et al. | 271/187 |
| 4,252,309 | A | 2/1981 | Garrison et al. | 271/186 |
| 4,629,175 | A * | 12/1986 | Fischer et al. | 271/202 |

FOREIGN PATENT DOCUMENTS

| | | |
|---|---|---|
| EP | 0 527 317 A2 | 6/1992 |
| EP | 0 673 868 A2 | 3/1995 |
| EP | 0 890 539 A2 | 7/1998 |
| EP | 1 318 094 A2 | 12/2002 |
| GB | 2 094 766 A | 9/1982 |
| WO | WO 90/15006 | 12/1990 |

* cited by examiner

*Primary Examiner*—Patrick Mackey
*Assistant Examiner*—Michael C McCullough

(57) ABSTRACT

At least two coaxially rotatable sheet conveyors, operating together with one another, are provided, of which the first sheet conveyor, with a jacket surface serving as placement for the sheet, specifies essentially a curvature path for the sheet to be conveyed, and the second sheet conveyor has at least one gripping element to grip the accepted front edge of the sheet, in such a way that the front edge of the sheet can be gripped and conveyed between the gripping element and the jacket sheet.

2 Claims, 2 Drawing Sheets

DEVICE FOR PLACING SHEETS FOR A PRINTER

FIELD OF THE INVENTION

The invention concerns a device for placing sheets for a printer, including at least one rotating, drivable sheet conveyor, which is provided to accept or grip a front edge of a sheet and to stack the sheet after traversing a rotation path.

BACKGROUND OF THE INVENTION

A stacking device for sheets, including a rotating drivable sheet conveyor, is, for example, known from U.S. Pat. No. 4,252,309. In this known sheet conveyor, the front edge is inserted into a slit of the conveyor, which is essentially disk-shaped. The sheet gripped in this manner is carried along and turned by half of a rotation of the sheet conveyor from an upper gripping site and subsequently stacked on the attained lower level on a placement site and there stacked on other sheets. From the slit, the sheet to be stacked is automatically freed in that the slit moves by a stop, which holds back the sheet.

The risk exists that the front edge of the sheet will be damaged in the slit and possibly, the sheet in the slit, into which it is only inserted, will not be held with sufficient reliability and in a correct position until the desired stacking is carried out.

SUMMARY OF THE INVENTION

The goal of the invention, therefore, is to indicate a functional alternative, which is preferably also suitable for sheets of different formats and weights.

This goal is attained, in accordance with the invention, by a stacking device, which has at least two coaxially rotatable conveyors, operating together with one another, of which the first conveyor, with a jacket surface, which serves as the placement for the sheet, essentially specifies a curvature path for the sheet to be conveyed, and the second sheet conveyor has at least one gripping element to grip the accepted front edge of the sheet, in such a way that the front edge of the sheet can be gripped and conveyed between the gripping element and the jacket surface.

With the device in accordance with the invention, functions are thus advantageously distributed on different elements, so that an all the more purposeful and more reliable functionality is attained.

The first sheet conveyor essentially takes over the disk body function and offers a layout and placement for the sheet, wherein this first sheet conveyor need not absolutely be a disk, but rather in accordance with a refinement, can also be segmented in the shape of a wheel or in another manner.

The second conveyor takes over, above all, a part of the holding function, in that it makes available a gripping element, which clamps the front edge of the sheet between itself and the jacket surface of the adjacent first sheet conveyor and holds it reliably in this way, without damaging the front edge. This second sheet conveyor, therefore, needs, even less, to be in the shape of a disk, but rather preferably, in accordance with a refinement of the invention, can be essentially a two-arm swivel beam, which has a gripping element in the area of its two free ends, which point radially outwards. By the gripping elements on both ends, the second sheet conveyor is ready to take over the next sheet, while it is placing the previous sheet, or shortly thereafter. Anyway, the preferably essentially rotation-symmetrical, first sheet conveyor is, in any case ready, in principle, in any rotation position and at all times.

The gripping element is preferably flat, as a tongue or flap, and optionally, in such a manner that it yields elastically, so that damage to the front edge of the sheet is avoided. The gripping element is, thereby, essentially as a tongue or flap following, approximately parallel, the curvature path of the guiding element.

A next further refinement of the invention provides for two first and two second coaxial sheet conveyors, which are arranged on the common axis, with mirror symmetry to one another, in such a way that the two second sheet conveyors are stacked between the two first sheet conveyors, so that a front edge of the sheet, in its course parallel to the common axis of the sheet conveyors, can be detected jointly by the, all total, four sheet conveyors. In this way, the sheet is advantageously securely gripped over its entire width and in particular, also prevents an inclined position or twisting by the transport.

For a particularly secure gripping, provision is preferably made so that the side of the gripping elements of the second sheet conveyors, facing the sheet, are, radially, not as far from the common axis as the gripped outside of the sheet applying its thickness on the radius of the jacket surfaces of the first sheet conveyors, so that the front edge of the sheet, in its course producing tension in the area of the gripping elements, is forced and bent somewhat in the direction of the common axis.

As is, in fact, known from the state of the art, the device in accordance with the invention has a stop for the front edges of the sheet, with which the sheet conveyors work together in the stacking of the sheets.

A next, particularly advantageous further refinement of the invention is that each of the second conveyors is repeatedly, preferably doubly, present, in such a way that several second conveyors can rotate around the common axis, essentially independently of one another, and thus one of these second conveyors is ready to accept or detect a next sheet, if another of these second sheet conveyors is still occupied with the transport or the stacking of a preceding sheet.

As already mentioned above, the second sheet conveyor is ready, in principle to take over, once again, the next sheet, while it is placing a preceding sheet, because it advantageously has two gripping elements, which are arranged diametrically opposite, relative to the rotation axis.

In reality, this applies, however, only if the sheets to be taken over have a suitable format. A sheet is namely passed on to the conveyor, preferably by transport rollers at the end of a transport path for stock. A good placement of the sheet is attained, in particular, if the transport rollers release the back edge of the sheet just as the front edge of the sheet reaches a stop on a release site, because then the sheet is pliantly stacked on a sheet stack. This means that the sheet should have a length with which it wraps around the sheet conveyor by just approximately half, that is, corresponding to approximately half the circumference of the jacket surface of the first sheet conveyor. This is, by no means, always the case, however. Longer or shorter formats are also transported. Anyway, heavier and stiffer stock, for example, cannot be bent very much, free of damage, so that as a precaution, with respect to such stock the radius of the first sheet conveyor is selected larger, rather, than would be suitable perhaps for the length of the sheet format. On the other hand, however, a uniform flow of sheets, if possible, should be transported for the utilization of the device, in which there will not arise an excessively large gap between successive sheets. However, successive sheets should not overlap either.

Thus, it may be that the free gripping element, which is to carry out the next takeover, could be available either too early or too late. In view of the described situation, this problem would not be solved either by equipping the first sheet conveyor with a larger number of gripping elements. Very probably, however, the solution in accordance with the invention makes available optimization possibilities, because the other second or another second sheet conveyor, can be made ready, adapted to the format of the sheet, independently and at a precise time.

With regard, in particular, to possible shorter sheet formats, the device in accordance with the invention advantageously includes at least one guide element, which blocks a gripped sheet, at least in the centrifugal direction, between a gripping site and a release site of the sheet, so as to force the retention of the curvature radius by the sheet. In this way, the gripped and transported sheet is still stacked securely in an intermediate position on the jacket surface of the first sheet conveyor, even if its back edge should come free from the transport rollers too early.

Making available of at least two second sheet conveyors, time is gained in the placement of the sheets, moreover, if desired, by making provision so that at least one displacement element, coupled with at least one of the sheet conveyors, is present for the transverse displacement of a sheet to be stacked, directed essentially parallel to the common axis of the sheet conveyor.

BRIEF DESCRIPTION OF THE DRAWINGS

An exemplified embodiment of a device, in accordance with the invention, from which other inventive features can also be deduced, but to which the invention is not restricted in its scope, is depicted schematically in the drawing, especially to illustrate the function course of such a device. The figures show the following.

DETAILED DESCRIPTION OF THE INVENTION

Figure 1:
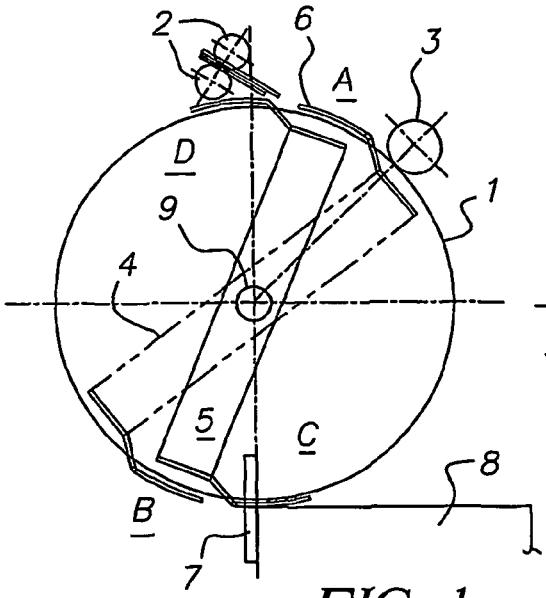
FIG. 1 shows sheet conveyors in accordance with the invention in a lateral view in a first rotation position.
Figure 2:
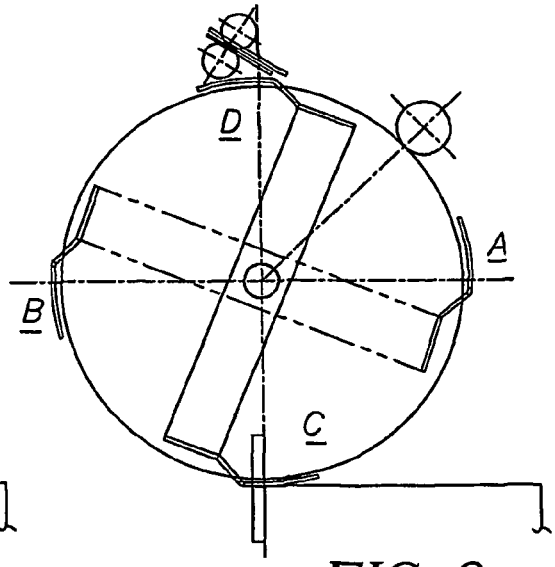
FIGS. 2 through 4 show the sheet conveyors in other rotation positions.
Figure 3:
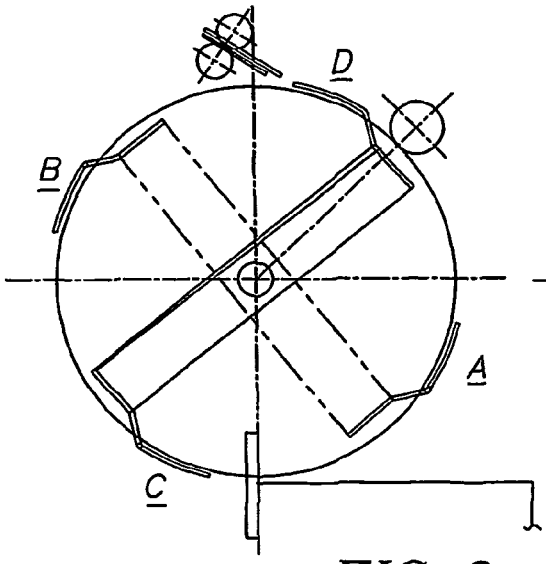
Figure 4:
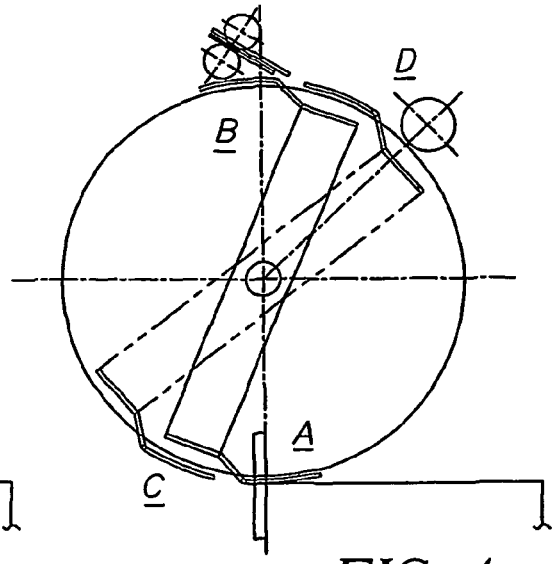

FIGS. 1 through 4, show sheet conveyors, in accordance with the invention in a lateral view, in different rotation positions to illustrate the functional course of such a device in accordance with the invention, by way of example. FIG. 1 depicts, in a lateral view, a first, essentially disk-shaped sheet conveyor 1, on which a sheet to be transported is stacked, which is passed on to the first sheet conveyor 1 by the last transport rollers 2, which form the end of a transport path for stock. For the forced placement of the sheet on the first sheet conveyor, a contact roller 3 is used as the guide element, which blocks in the centrifugal direction and which can advantageously be adjusted along the circumference of the first sheet conveyor 1, in order to be able to guide different sheet formats reliably and over a sufficiently long time.

The device in accordance with the invention also includes, in the depiction of FIGS. 1 through 4, two second sheet conveyors 4, 5, which are essentially two-arm swivel beams and have a flap-like gripping element 6 at each of their free ends. A sheet to be transported can be held and inserted, with the front edge of the sheet, in the slit between the first sheet conveyor 1 and a gripping element 6 and by the joint rotation of the first sheet conveyor 1 and the second sheet conveyors 4 or 5, concerned with its individual gripping element 6, are conveyed to a stop 7 and there, are stacked on a sheet stack 8. The two second sheet conveyors 4, 5 can be rotated around the common rotation axis 9, in principle, independently of one another, so that they can assume different rotation positions, in order to take over one sheet after the other from the transport rollers 2, in as short as possible a sequence, and to be able to stack them on the sheet stack 8. The individual positions of the decisive gripping elements 6 are made more recognizable in FIGS. 1 through 4 in that they are designated A, B, C, and D to distinguish one from the other.

With the aid of FIGS. 1 through 4, the course of the function of the device in accordance with the invention can thus be described briefly as follows:

The first second sheet conveyor 4 is positioned in such a way that the gripping element A is located in the sheet acceptance position. The second second sheet conveyor 5 follows the sheet conveyor 4 with its gripping element D at a short distance. This results from the fact that on the opposite side (area of the stop 7) of the second second sheet conveyor 5, the gripping element C is stacked in such a way that it is precisely there that a sheet can be engaged with the stop 7. This second second sheet conveyor 5 can remain in the described position until the first second conveyor 4, with the next sheet to be stacked, runs downwards and must run into the area of the stop 7.

This intermediate stop of the gripping elements 6 in the area of the stop 7, which are to engage a sheet with the stop 7, is advantageous, if, as preferably provided for, an offset displacement of the sheets is to be carried out before the stop 7, that is, if at least one displacement element, which is not depicted in more detail and is coupled with at least one of the sheet conveyors 1, 4, 5, is provided for the transverse displacement of a sheet to be stacked, directed essentially parallel to the common axis 9 of the sheet conveyors.

If gripping element A, with the next sheet to be stacked, has moved downwards and has practically assumed the position from gripping element C, then gripping element D has already moved into the sheet acceptance position. Basically, the two second sheet conveyors 4, 5 hurry after one another but never collide. Alternately, the second conveyors, 4,5 take over the guide roller.

What is important in this solution is also that after the start of the transport of a sheet in the direction of the stop 7, the following second sheet conveyor 4 or 5, with a gripping element 6, can move into the sheet acceptance position below the sheet to be stacked. Therefore, the small gap between two sheets arriving at the transport rollers 2 need not be used, in order to lead the next gripping element 6 into the sheet acceptance position.

The following sequence of steps results:

First step/Fourth step (FIG. 1):

Sheet conveyor 4 with gripping element is in the sheet acceptance position;

sheet conveyor 5 follows, at a short distance, sheet conveyor 4 with the gripping element D;

parallel to this, sheet conveyor 5 could stack a sheet on the stack edge with segment C, or allow an offset movement to take place there.

Second step (FIG. 2):

Sheet conveyor 4 moves with the newly accepted sheet in the direction of stop 7;

sheet conveyor 5 remains in the previous position;

contact roller 3 has taken over the sheet transport.

Third step (FIG. 3):

Sheet conveyor 4 has again moved the sheet in the direction of stop 7 via gripping element A;

sheet conveyor 5 has turned enough so that gripping element D is in the sheet assumption position.

Fourth step/First step (FIG. 4):

sheet conveyor 4 has conducted the sheet to the stop 7 via gripping element A and is stopped there temporarily. An offset displacement could not be carried out with the sheet found at the stop 7;

gripping element D, found in the sheet acceptance position can take up the next sheet.

The sequence of the steps 3 and 4 shown, one after the other, can also take stack chronologically overlapped. This is advantageously the case with shorter sheet formats. While one sheet is still being conveyed in the direction of the stop 7, the next sheet can already move into a following gripping element 6. As soon as the back edge of the sheet is conveyed out of the gripping area of the contact roller 3, the next gripping element 6, with the next sheet, can move into this contact roller area.

Basically, the second sheet follows the first with the corresponding gap. So that after the acceptance of two very short sheets, a gap will not appear in the transport area of the gripping elements 6 (with, all total, only two gripping elements 6, both would be found on one half of the disk-shaped first sheet conveyor 1), the two second sheet conveyors 4, 5 are equipped with two gripping elements 6 and not only one. In this way, the gap is automatically closed, again and again, without a gripping element 6 having to be conveyed, accelerated, into the sheet acceptance position over the half circumference of the guide.

Figure 5:
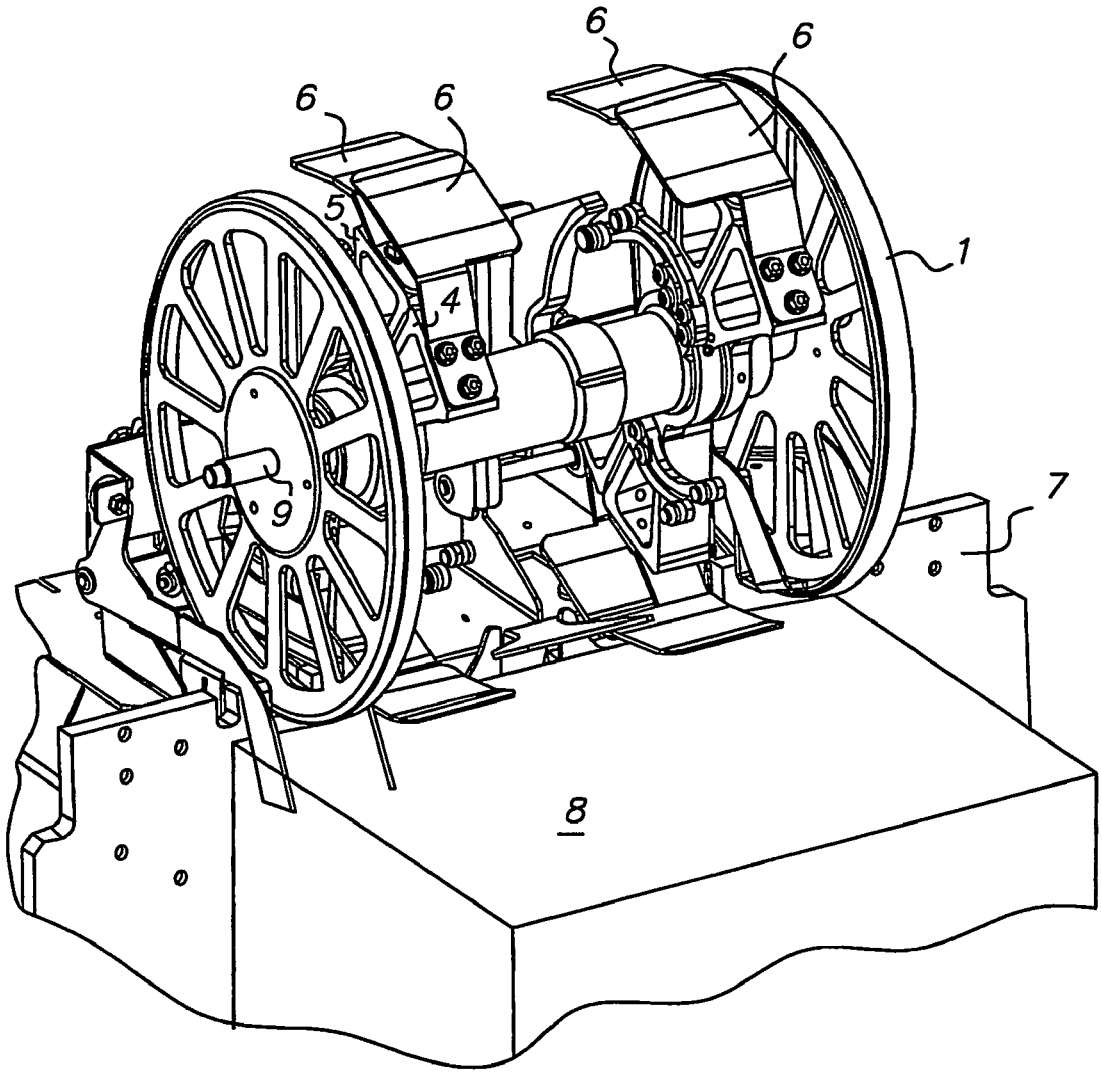
FIG. 5 is a perspective view of a device in accordance with the invention with sheet conveyors according to FIGS. 1 through 4.

FIG. 5 shows, in a perspective view, an embodiment example of a device in accordance with the invention. The same components are designated with the same reference numbers as in FIGS. 1 through 4. One can see in FIG. 5, in particular, that two first sheet conveyors 1 and four second sheet conveyors 4, 5 sit on the axis 9, with mirror symmetry to one another, in such a way that the two first sheet conveyors 1 are found outside and the second sheet conveyors 5, 5, in between.

The invention claimed is:

1. Device for the placement of sheets for a printer, said device comprising:

at least one first sheet conveyor in the shape of a disk having a jacket surface, serving as a support for a sheet, defining a curvature path for the conveyance of sheets; and at least two second sheet conveyors each having at least a pair of gripping elements, each of said respective gripping elements including a tongue, which follows parallel to the curvature path of the jacket surface of said at least one first sheet conveyor to grip a front edge of a sheet in such a way that the front edge of the sheet can be gripped and conveyed respectively between each of said gripping elements and the jacket surface, said at least two second sheet conveyors being essentially two-arm swivel beams with two free ends pointing radially outwards, each free end having a respective one of said gripping elements, said gripping elements of said at least two second sheet conveyors are repeatedly presented, in such a way that said at least two second sheet conveyors can be rotated on a common axis, essentially independently of one another, and thus one of said gripping elements of said at least two second sheet conveyors are ready to grip the next sheet, if another of said gripping elements is still occupied with the transport of a preceding sheet.

2. Device according to claim 1, wherein there is provided at least two of said first sheet conveyors and at least two of said second sheet conveyors, all of said first and second sheet conveyors being arranged on the common axis with mirror symmetry to one another, in such a way that the at least two second sheet conveyors are arranged between the at least two first sheet conveyors so that a front edge of the sheet, in its course parallel to the common axis of the at least two first and second sheet conveyors can be gripped jointly by at least one of the first sheet conveyors and at least one of the second sheet conveyors.

* * * * *